US006274801B1

(12) United States Patent
Wardley

(10) Patent No.: US 6,274,801 B1
(45) Date of Patent: Aug. 14, 2001

(54) INSTRUMENT PICKUP ASSEMBLY AND ASSOCIATED METHOD OF ATTACHING THE SAME TO A STRINGED INSTRUMENT

(76) Inventor: David E. Wardley, 45C Ambler Avenue, Glen Eden, Auckland (NZ), 1007

( * ) Notice: Subject to any disclaimer, the term of this patent is extended or adjusted under 35 U.S.C. 154(b) by 0 days.

(21) Appl. No.: 09/584,295

(22) Filed: May 31, 2000

(51) Int. Cl.[7] ..... G10H 3/18
(52) U.S. Cl. ..... 84/731; 84/275; 84/DIG. 24
(58) Field of Search ..... 84/731, 274–277, 84/267, DIG. 24

(56) References Cited

U.S. PATENT DOCUMENTS 3,538,232 * 11/1970 Bachtig et al. ..... 84/731
3,624,264 * 11/1971 Lazarus ..... 84/731 X
3,733,425 * 5/1973 Chaki ..... 84/731
4,168,647 * 9/1979 Petillo ..... 84/731
4,501,186 * 2/1985 Ikuma ..... 84/731 X
4,607,559 * 8/1986 Armin ..... 84/275

* cited by examiner

*Primary Examiner*—Stanley J. Witkowski
(74) *Attorney, Agent, or Firm*—Factor & Partners, LLC

(57) ABSTRACT

An instrument pickup assembly comprising, a piezoelectric transducer configured for association with a belly of a stringed instrument, a transmittable conduit associated with said piezoelectric transducer at a first end thereof, and means for securely positioning said piezoelectric transducer onto said belly of said stringed instrument.

17 Claims, 3 Drawing Sheets

INSTRUMENT PICKUP ASSEMBLY AND ASSOCIATED METHOD OF ATTACHING THE SAME TO A STRINGED INSTRUMENT

BACKGROUND OF THE INVENTION

1. Field of the Invention

The present invention relates in general to an instrument pickup assembly, and more particularly, to an instrument pickup assembly which is associable with a belly of a stringed instrument. The present invention further relates to an associated method of attaching such an instrument pickup assembly to a stringed instrument.

2. Background Art

Amplifying mechanisms for use in association with stringed instruments, such as a violin or viola, have been known in the art for years. Indeed, the demand for such amplifying mechanisms can be great when playing a stringed instrument, inasmuch as the acoustic output from the stringed instrument can be relatively low compared to other accompanying instruments. For example, in many modern day bands, electric instruments are commonly used which are capable of volume levels substantially greater than the acoustic output of a stringed instrument. In addition, it may be desirous for a solo musician to perform in a large music hall or auditorium. In such an environment, the musician may need to be supported by an amplification mechanism to raise the gain to a sufficient sound level so that the musician can be properly heard throughout the music hall or auditorium.

While several amplification mechanisms have been explored in an attempt to overcome the above-identified problems, each of the known amplification mechanisms have substantial drawbacks, thereby rendering such amplification mechanisms largely non-remedial and problematic. In particular, one attempt to remedy the above-identified problem has been to place one or more floor or ceiling engaging microphones near the musician. These microphones have several drawbacks. First, the gain or amplification required can easily introduce unwanted noise and/or feedback sound levels. Second, the musician is severely limited in body movement and extreme care is needed to maintain the instrument at a constant, appropriate distance from the input of the microphone. Third, conventional microphones are typically optimized for vocal tones. As such, common stage microphones do not respond well to the complex tones of stringed instruments, such as, for example, a violin or viola—that is, they do not accurately and precisely reproduce the native or original sounds of the particular stringed instrument to an acceptable degree.

A second attempt to resolve the amplification problems associated with stringed instruments has been to position a microphone onto the bridge of the stringed instrument. While placing a microphone onto the bridge of the stringed instrument allows the musician greater freedom than do fixed position microphones, such positioning creates a secondary problem. Specifically, when a microphone is associated with the bridge of an instrument, the instrument's original acoustic sound is adversely altered—typically with a "deadening" effect.

A third attempt to resolve the amplification problems associated with stringed instruments has been to mount a pickup to the bridge of the stringed instrument. Similarly to positioning a microphone onto the bridge of the stringed instrument, the musician is afforded greater freedom of movement. Nevertheless, when the pickup is mounted to the bridge of the stringed instrument, it mutes the acoustic sound of the same by dampening, restricting, and/or modifying the transfer of vibrations to the body of the instrument. Additionally, either adhesives or screws are used to affix the pickup to the bridge, the most sensitive part of the instrument, which readily damages, marks, and/or otherwise devalues the instrument—which can cost tens of thousands of dollars.

One solution for the guitar family of stringed instruments has been to associate a magnetic pickup with instrument. However, due to the unique construction of the violin family of instruments, the use of magnetic pickups is denied. In particular, the composition of the strings are not generally of a suitable material to disturb a magnetic field and the proximity of the strings changes as they are pressed downwards by the "playing" fingers on the fingerboard.

It is therefore an object of the present invention to provide a low-cost, reliable instrument pickup assembly for use in association with a stringed instrument which remedies the aforementioned detriments and/or complications associated with prior art amplification mechanisms.

It is therefore a further object of the present invention to fully capture the sound characteristics of a stringed instrument without modification to the instrument's original structure, sound, and/or associated components.

These and other objects of the present invention will become apparent in light of the present specification, claims, and drawings.

SUMMARY OF THE INVENTION

The present invention is directed to an instrument pickup assembly comprising: (a) a piezoelectric transducer configured for association with a belly of a stringed instrument; (b) a transmittable conduit associated with the piezoelectric transducer at a first end thereof; and (c) means for securely positioning the piezoelectric transducer onto the belly of the stringed instrument.

In a preferred embodiment of the invention, the piezoelectric transducer is at least partially covered with a substantially non-scratching material. In such an embodiment, the piezoelectric transducer may be covered with a material selected from said group consisting essentially of plastics, rubberized materials, natural polymeric resins, synthetic polymeric resins, and mixtures thereof.

In another preferred embodiment of the invention, the transmittable conduit is further associated with a connector for association with at least one of the group selected from additional transmittable conduit, a preamplifier, an amplifier, a speaker, a control system, a sound system, and mixtures thereof.

In yet another preferred embodiment of the invention, the means for securely positioning the piezoelectric transducer onto the belly of an instrument comprises a substantially C-shaped clamp. Preferably, the substantially C-shaped clamp is at least partially covered with a substantially non-scratching material such as, for example, plastics, rubberized materials, natural polymeric resins, synthetic polymeric resins, and mixtures thereof. The substantially C-shaped clamp may optionally be integrally fabricated with the piezoelectric transducer.

The present invention is further directed to an instrument pickup assembly associated with a stringed instrument comprising: (a) a stringed instrument having a belly; (b) a piezoelectric transducer associated with the belly of the stringed instrument; (c) a transmittable conduit associated with the piezoelectric transducer at a first end thereof; and (d) means for securely positioning the piezoelectric transducer onto the belly of the stringed instrument.

The present invention is also directed to a method of attaching an instrument pickup assembly to an instrument having a belly comprising the steps of: (a) providing a piezoelectric transducer, transmittable conduit, and a clamp; (b) providing a stringed instrument having a belly; (c) placing the piezoelectric transducer associated with transmittable conduit on the belly of said instrument adjacent a soundhole in close proximity to a sound post; and (d) securing the piezoelectric transducer on the belly with the clamp.

BRIEF DESCRIPTION OF THE DRAWINGS

The invention will now be described with reference to the drawings wherein.

DETAILED DESCRIPTION OF THE INVENTION

Figure 1:
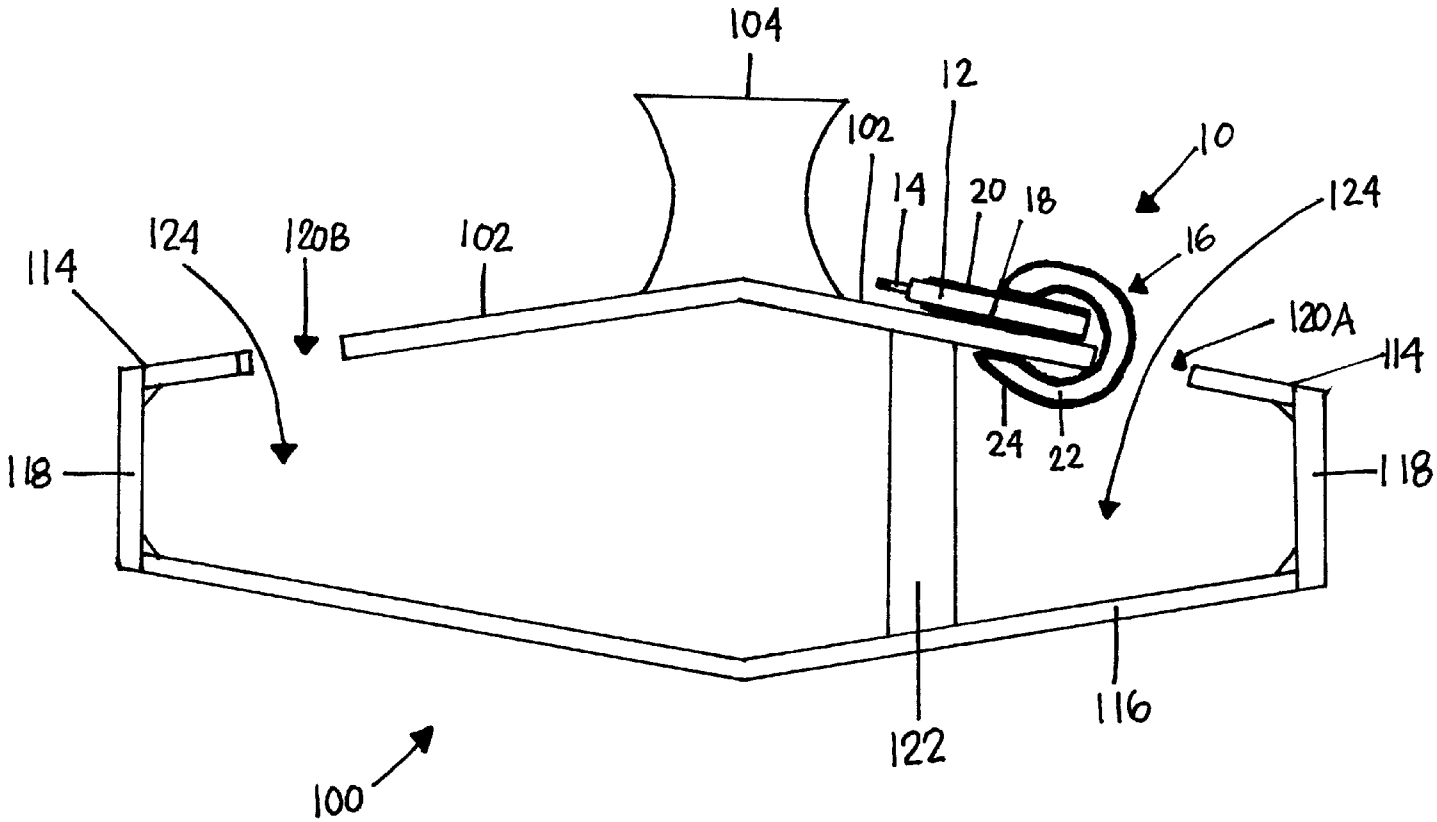
FIG. 1 of the drawings is a cross-sectional schematic representation of an instrument pickup assembly associated with a stringed instrument in accordance with the present invention.

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

Referring now to the drawings and to FIG. 1 in particular, a cross-sectional schematic representation of instrument pickup assembly 10 is shown, which generally comprises piezoelectric transducer 12, transmittable conduit 14, and transducer positioning means 16. As will be discussed in greater detail below, instrument pickup assembly 10 is shown in FIG. 1 as being associated with belly 102 of stringed instrument 100. However, instrument pickup assembly 10 is not associated with bridge 104. As such, instrument pickup assembly 10 can fully capture the complex sound characteristics produced by stringed instrument 100, without adversely altering and/or otherwise "deadening" the tonal characteristics of the instrument. It will be understood that FIG. 1 is merely a schematic representation of instrument pickup assembly 10 and stringed instrument 100. As such, some of the components have been distorted from their actual scale for pictorial clarity. For purposes of the present disclosure stringed instrument 100 comprises a violin, however, any one of a number of stringed instruments are contemplated for use in association with instrument pickup assembly 10, such as, for example, a viola, bass, cello, mandolin, guitar, etc.

Piezoelectric transducer 12 includes outer surface 18, which is preferably at least partially covered with a substantially non-scratching material 20 such as, for example, plastics, rubberized materials as well as natural and/or synthetic polymeric resins and associated composites. Non-scratching material 20 associated with piezoelectric transducer 12, generally contacts belly 102 of instrument 100 so as to substantially preclude inadvertently scratching, marking, damaging, and/or otherwise devaluing belly 102, and in turn, stringed instrument 100. As can be seen, piezoelectric transducer 12 is associated with belly 102, but not bridge 104. As such, piezoelectric transducer 12 does not deaden, alter, or otherwise adversely affect the complex tonal sound characteristics produced by stringed instrument 100. Regardless of its ordinary meaning, the term "piezoelectric transducer" is herein defined as a component which is capable of converting mechanical or acoustical signals (i.e. pressure waves) into electrical signals.

Transmittable conduit 14 is associated with piezoelectric transducer 12 and serves to transmit electrical signal from piezoelectric transducer 12 to a predetermined source, such as a filter, pre-amplifier, amplifier, speaker, control system, and/or sound system. It will be understood that transmittable conduit 14 is fabricated from conventional materials well known in the art.

For purposes of the present disclosure, transducer positioning means 16 comprises clamp 22, which is substantially C-shaped. As will be discussed in greater detail below, clamp 22 frictionally secures piezoelectric transducer 12, and, in turn, transmittable conduit 14 to a predetermined location on belly 102 of stringed instrument 100, whereby bridge 104 of instrument 100 is not altered, modified, otherwise manipulated from its original, native state. Preferably instrument pickup assembly 10 is positioned adjacent soundhole 120A in relatively close proximity to sound post 122.

Clamp 22 may be fabricated from plastic, however, any one of a number of fabrication materials are contemplated for use—so long as the particular material is compatible, in either a covered or uncovered state, with belly 102 of instrument 100. Clamp 22 is preferably at least partially covered with a substantially non-scratching material 24 such as, for example, plastics, rubberized materials as well as natural and/or synthetic polymeric resins and associated composites. It will be understood that non-scratching material 24 protects clamp 22 from scratching the underside of belly 102 as well as the top surface of piezoelectric transducer 12.

Alternatively, clamp 22 and piezoelectric transducer 12 may be integrated together. In this manner, integrated instrument pickup assembly 10 may clamp directly onto an instrument rather than having a separate securing means.

While transducer positioning means 16 has been shown, for illustrative purposes only as comprising a substantially C-shaped clamp, it will be understood that numerous other geometrically shaped clamp configurations are likewise contemplated for use—so long as the particular geometric configuration does not adversely affect either the complex tonal characteristics of an associated instrument, or devalue the finish of the same.

Figure 2:
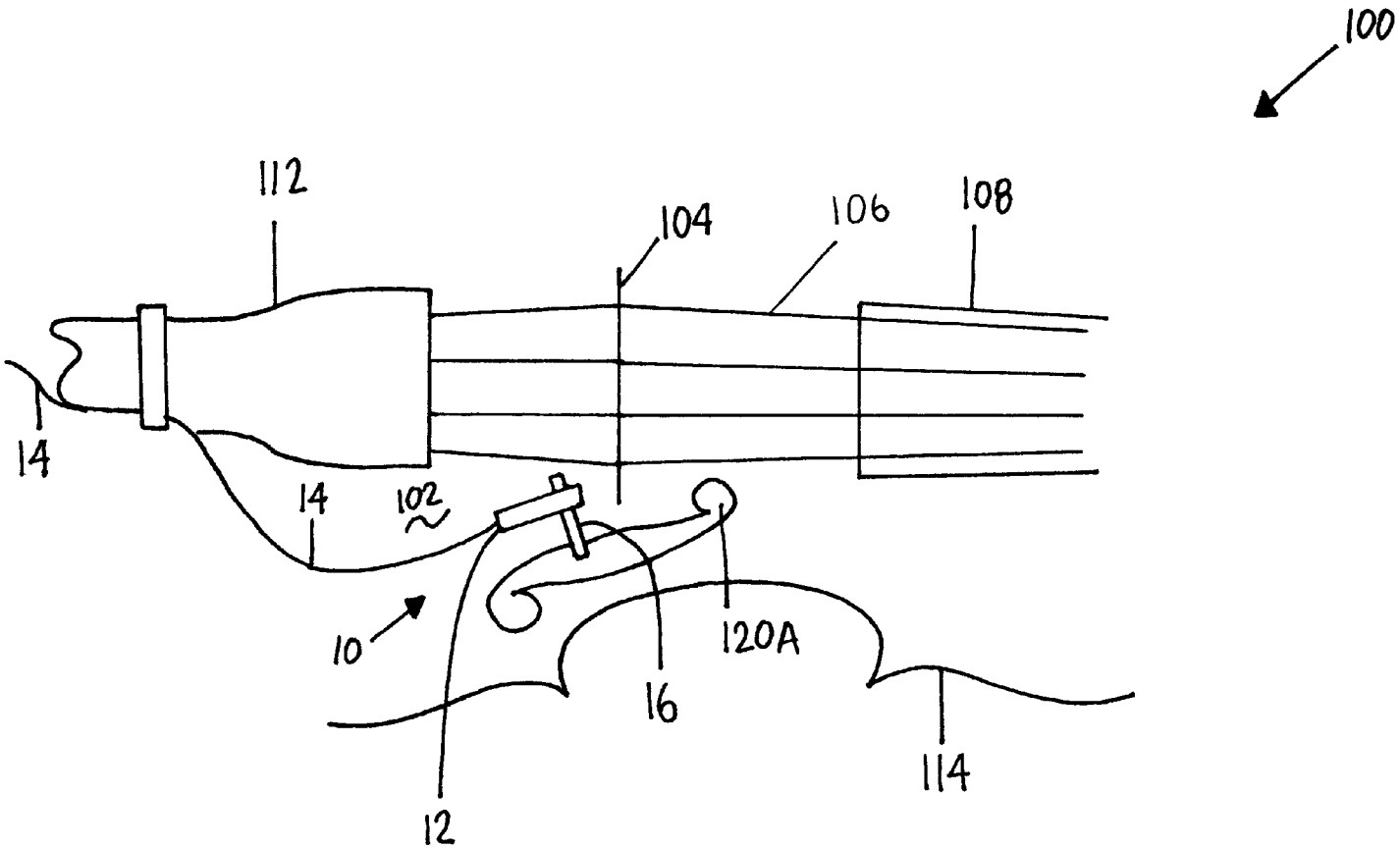
FIG. 2 of the drawings is a top plan schematic representation of an instrument pickup assembly associated with a stringed instrument in accordance with the present invention.

As is shown collectively in FIGS. 1 and 2, stringed instrument 100 includes a plurality of strings 106 that stretch across fingerboard 108 from a peg box (not shown) to tailpiece 112 passing over bridge 104. Bridge 104 rests directly on instrument body 114 and is held firmly in place by the tension of strings 106. Instrument body 114 is comprised of, among other parts, belly 102, back plate 116 and ribs 118. Between belly 102 and back plate 116 is sound post 122. On either side of bridge 104 are soundholes 120A and 120B.

When one or more of the plurality of strings 106 are "bowed" or "plucked," vibrations (i.e. sound/pressure waves) are created and transferred through bridge 104 and into instrument body 114, which acts as a built-in amplifier. Vibrations first enter the body from belly 102 and pass to back plate 116 through sound post 122. Ribs 118 also aid in vibration transfer from belly 102 to back plate 116, but generally in a secondary fashion. Instrument body 114 amplifies the sounds of the strings, and the air within the hollow portion 124 of instrument body 114 carries the sound waves out through soundholes 120A and 120B. As previously discussed, certain conditions such as, for example, playing in a multi-piece band, or, alternatively playing in a large auditorium can necessitate the amplification of sound level from stringed instrument 100. In order to amplify the sound to a greater level, stringed instrument 100 is associated with an external amplifier via instrument pickup assembly 10. Instrument pickup assembly 10 is connected to one end of transmittable conduit 14, which then feeds into an amplifier, preamplifier, filter, control system, or the like. Optionally, an adapter may be connected to the opposite end of transmittable conduit 14 to removably connect to an external amplification system.

In this manner, when one or more of the plurality of strings 106 are bowed or plucked, the vibrations created are converted into electrical signals that correspond to the amplitude and frequency of the vibrations by instrument pickup assembly 10. The electrical signals are, in turn, relayed though transmittable conduit 14 to at least one of a preamplifier, an amplifier, a filter, a speaker, a control system, a sound system, and the like. Accordingly, the sounds generated by stringed instrument 100 may be fully captured and amplified without modification to the instrument's original structure, sound, and/or associated components.

Figure 3:
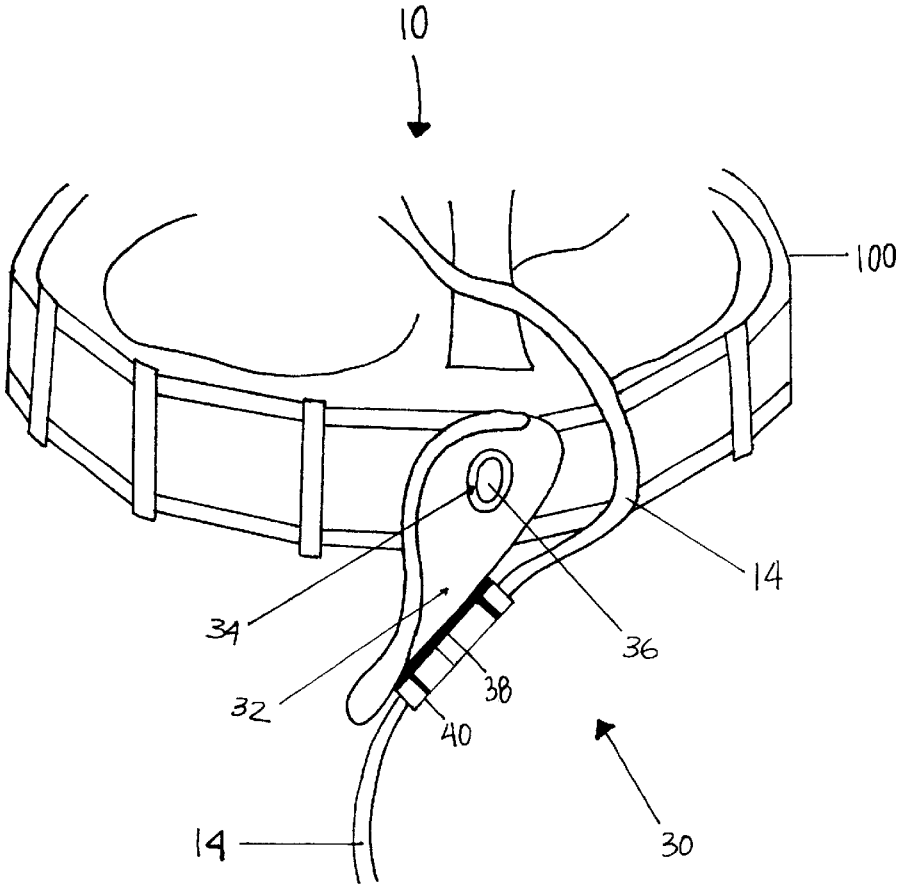
FIG. 3 of the drawings is a fragmentary perspective view of an instrument pickup assembly associated with a stringed instrument in accordance with the present invention showing, among other things, transmitting conduit retaining means.

As is shown in FIG. 3, instrument pickup assembly 10 associated with stringed instrument 100 may also include transmitting conduit retaining means 30. Transmitting conduit retaining means 30 preferably comprises retaining member 32 having aperture 34 which is secured to a peg 36 of the stringed instrument. For purposes of the present disclosure, retaining member 32 may be fabricated from leather, vinyl, natural and synthetic materials, etc. Retaining member 32 serves at least two functions. First, retaining member 32 protects stringed instrument 100 against damage from inadvertent contact by connector 38. Second, retaining member 32 in cooperation with strap member 40, serves to secure connector 38 in a relatively fixed position so that conventional, associated male and female components of connector 38 do not become disassociated or otherwise intermittently connected.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. An instrument pickup assembly, comprising:

a piezoelectric transducer having a first surface and a second surface opposite said first surface, wherein said first surface is configured for direct placement onto an outside surface of a belly of a stringed instrument;

a transmittable conduit associated with said piezoelectric transducer at a first end thereof; and a clamp configured for directly engaging both an inside surface of said belly of said stringed instrument and said second surface of said piezoelectric transducer.

2. The instrument pickup assembly according to claim 1, wherein said piezoelectric transducer is at least partially covered with a substantially non-scratching material.

3. The instrument pickup assembly according to claim 2, wherein said piezoelectric transducer is covered with a material selected from the group consisting of plastics, rubberized materials, natural polymeric resins, synthetic polymeric resins, and combinations thereof.

4. The instrument pickup assembly according to claim 1, wherein said transmittable conduit is further associated with a connector for association with a component selected from the group consisting of additional transmittable conduit, a preamplifier, an amplifier, a speaker, a control system, a sound system, and combinations thereof.

5. The instrument pickup assembly according to claim 1, wherein said clamp comprises a substantially C-shaped clamp.

6. The instrument pickup assembly according to claim 5, wherein said substantially C-shaped clamp is at least partially covered with a substantially non-scratching material.

7. The instrument pickup assembly according to claim 6, wherein said substantially C-shaped clamp is covered with a material selected from the group consisting of plastics, rubberized materials, natural polymeric resins, synthetic polymeric resins, and combinations thereof.

8. The instrument pickup assembly according to claim 1, wherein said clamp comprises a substantially C-shaped clamp integrally fabricated with said piezoelectric transducer.

9. An instrument pickup assembly associated with a stringed instrument, comprising:

a stringed instrument having a belly, wherein said belly includes an inside and an outside surface;

a piezoelectric transducer having a first surface and a second surface opposite said first surface, wherein said first surface is directly placed onto said outside surface of said belly of said stringed instrument;

a transmittable conduit associated with said piezoelectric transducer at a first end thereof; and a clamp directly engaging both said inside surface of said belly of said stringed instrument and said second surface of said piezoelectric transducer.

10. The instrument pickup assembly according to claim 9, wherein said piezoelectric transducer is at least partially covered with a substantially non-scratching material.

11. The instrument pickup assembly according to claim 10, wherein said piezoelectric transducer is covered with a material selected from the group consisting of plastics, rubberized materials, natural polymeric resins, synthetic polymeric resins, and combinations thereof.

12. The instrument pickup assembly according to claim 9, wherein said transmittable conduit is further associated with a connector for association with a component selected from the group consisting of additional transmittable conduit, a preamplifier, an amplifier, a speaker, a control system, and combinations thereof.

13. The instrument pickup assembly according to claim 9, wherein said clamp comprises a substantially C-shaped clamp.

14. The instrument pickup assembly according to claim 13, wherein said substantially C-shaped clamp is at least partially covered with a substantially non-scratching material.

15. The instrument pickup assembly according to claim 14, wherein said substantially C-shaped clamp is covered with a material selected from the group consisting of plastics, rubberized materials, natural polymeric resins, synthetic polymeric resins, and combinations thereof.

16. The instrument pickup assembly according to claim 9, wherein said clamp comprises a substantially C-shaped clamp integrally fabricated with said piezoelectric transducer.

17. A method of attaching an instrument pickup assembly to an instrument having a belly, comprising the steps of:

providing a piezoelectric transducer having a first surface and a second surface opposite said first surface, a transmittable conduit, and a clamp;

providing a stringed instrument having a belly, wherein said belly includes an inside and an outside surface;

placing said piezoelectric transducer associated with said transmittable conduit directly onto said outside surface of said belly of said instrument adjacent a soundhole in close proximity to a sound post; and directly engaging a clamp onto both said inside surface of said belly of said stringed instrument and said second surface of said piezoelectric transducer.

* * * * *